United States Patent [19]

Mullins

[11] 4,187,069

[45] Feb. 5, 1980

[54] COMBINATION DIE AND PALLET ASSEMBLY

[76] Inventor: Wayne L. Mullins, 5001 E. Cactus, Scottsdale, Ariz. 85254

[21] Appl. No.: 947,452

[22] Filed: Oct. 2, 1978

[51] Int. Cl.[2] ..... B28B 1/14

[52] U.S. Cl. ..... 425/470; 52/593; 52/606; 249/120

[58] Field of Search ..... 425/470; 249/120; 52/593, 606

[56] References Cited

U.S. PATENT DOCUMENTS

| | | | |
|---|---|---|---|
| 3,998,423 | 12/1976 | Mullins | 249/120 |
| 4,060,952 | 12/1977 | Hernandez | 52/593 |
| 4,078,760 | 3/1978 | Mullins | 249/120 |
| 4,093,174 | 6/1978 | Mullins | 249/120 |
| 4,107,894 | 8/1978 | Mullins | 52/593 |

*Primary Examiner*—William E. Schulz

*Attorney, Agent, or Firm*—Herbert E. Haynes, Jr.

[57] ABSTRACT

A combination die and pallet assembly upon which mortarless interlocking cementitious blocks of the type having a plurality of cast male projections thereon, includes a die and pallet plate of solid heavy gage metal with a predetermined array of frustro-conical apertures formed therethrough, and a solid heavy gage metal backing plate removably disposed in contiguous engagement with the bottom surface of the die and pallet plate.

6 Claims, 2 Drawing Figures

COMBINATION DIE AND PALLET ASSEMBLY

BACKGROUND OF THE INVENTION

1. Field of the Invention

This invention relates to devices for casting cementitious building blocks and more particularly to a combination die and pallet assembly upon which mortarless interlocking cementitious blocks are cast with a plurality of male projections.

2. Description of the Prior Art

Due to the shortage of skilled craftsmen and high labor costs, the search for and development of practical and easy to use mortarless interlocking cementitious blocks has intensified in recent years. One such block, which is beginning to receive general acceptance in the market place, is fully disclosed in U.S. patent application Ser. No. 799,725, filed on May 23, 1977 by the same inventor. Briefly, that mortarless interlocking cementitious block is formed with the conventional rectangular configuration having a pair of vertical passages formed therethrough, and is provided with a plurality of frustro-conical recesses in one of the horizontal surfaces, and complimental frustro-conical male projections on the opposite surface. The recesses and projections are disposed in identical predetermined arrays, and are the block interlocking elements which allows the blocks to be laid in an accurately level and aligned manner by relatively unskilled laborers.

These particular mortarless interlocking cementitious blocks are cast in special mold box assemblies which are used in conjunction with conventional block making machines, with the mold boxes designed to simultaneously cast a plurality of such blocks for production efficiency purposes. The special mold box assembly includes a special head die which forms the frustro-conical female recesses and the top horizontal surface in which they are formed, a special mold box die which forms the side wall configuration and vertical passages of the block, and a special combination die and pallet which forms the frustro-conical male projections and the bottom horizontal surface from which they project.

After the blocks are cast in the above described mold box assembly, the head die is raised and the combination die-pallet structure is lowered with such lowering causing the blocks to be withdrawn from the bottom of the mold box die, and they remain in position atop the die-pallet for subsequent handling. The subsequent handling includes transporting of the die-pallet structure, with the blocks supported thereon, from the block making machine to a kiln for curing. After curing, the die-pallet structure and blocks are again transported, this time from the kiln to a machine which removes the blocks from the die-pallet structure. From this point, the die-pallet structures are routed through suitable cleaning and lubricating mechanisms and are returned to the block making machine for reuse.

Since the combination die-pallet structure is an integral part of the casting operation with the integrity of the blocks themselves being partially dependent thereon, it is extremely important that they be dimensionally accurate and stable, perfectly flat, and otherwise precision structures. In addition to the required precision and stability, the combination die-pallet structures must be: sufficiently strong to resist damage which can and sometimes does occur during the above described subsequent handling operations, easy to repair in the event of damage, and must resist rust out as a result of long periods of exposure to moisture.

Heretofore, the combination die-pallet structures employed have been sheet metal structures fabricated with an upper and a lower plate which are welded together with reinforcing ribs interposed therebetween. Basic configurations of these laminated honeycombed sheet metal diepallet structures are fully disclosed in U.S. Pat. Nos. 3,998,423 issued Dec. 21, 1976; 4,078,760 issued Mar. 14, 1978; and 4,093,174 issued June 6, 1978, all to the same inventor. These prior art combination die-pallet structures although serving the purpose have some shortcomings, in that they are relatively expensive to manufacture, are subject to damage such as denting, bending and the like, are somewhat difficult to repair, and are subject to rust out.

Therefore, a need exists for a new and improved combination die-pallet assembly which overcomes some of the problems and shortcomings of the prior art.

SUMMARY OF THE INVENTION

In accordance with the present invention, a new and improved combination die and pallet assembly is disclosed for use in casting mortarless interlocking cementitious blocks, of the type disclosed in the hereinbefore referenced U.S. patent application, and for supportingly carrying those blocks through the various operations subsequent to casting.

The combination die and pallet assembly of the present invention includes a rectangular die and pallet plate of solid heavy gage metal with a plurality of frustro-conical apertures formed therethrough, with those apertures disposed in a predetermined array. The apertures are arranged in longitudinal and transverse rows, with the spacing being in accordance with the pattern of projections which are to be cast on the blocks. In accordance with accepted industry practices, three blocks are cast simultaneously, thus, the die and pallet plate is provided with a sufficient number of the apertures to simultaneously form the desired pattern of projections on three blocks.

In addition to the die and pallet plate, the combination die and pallet assembly of the present invention further includes a solid heavy gage metal backing plate which is disposed in contiguous engagement with the bottom surface of the die and pallet plate during block casting operations, and is separated from the die and pallet plate during subsequent block handling operations.

The solid heavy gage metal die and pallet plate is inherently a dimensionally stable precision structure which resists damage, rust out and the like, and is easy to repair and otherwise maintain. In addition to the above described inherent advantages of the solid heavy gage die and pallet plate, some other unexpected advantages appeared during development and testing of the structure of the present invention.

Since the apertures are formed through the heavy gage metal plate, such as by drilling, rather than being depressions stamped in sheet metal as is the case in the prior art structures, the apertures themselves have sharp edges rather than the radiused edges of the prior art depressions. The sharp edges of the apertures result in sharp edges being cast on the blocks, and this in turn results in an improved interlocking fit between the layed blocks. Also, since the apertures passed through the plate, the problems of deformed or otherwise damaged projections resulting from dried cement particles, foreign matter and the like, collecting in the prior art depressions has been eliminated, and the chances of air entrapment has been substantially reduced. Another benefit derived from the apertures being formed through the solid heavy gage metal die and pallet plate, is the improved curing characteristics of the block resulting from direct exposure of the cast projections to the heat of the kiln.

Accordingly, it is an object of the present invention to provide a new and improved combination die and pallet assembly for casting and subsequent handling of mortarless interlocking cementitious blocks.

Another object of the present invention is to provide a new and improved combination die and pallet assembly for casting and subsequent handling of mortarless interlocking cementitous blocks with the assembly being inexpensive to manufacture and simple to use.

Another object of the present invention is to provide a new and improved combination die and pallet assembly for casting and subsequent handling of mortarless interlocking cementitious blocks, with the assembly being a dimensionally stable and precision structure, which is of sufficient strength to resist damage.

Another object of the present invention is to provide a new and improved combination die and pallet assembly for casting and subsequent handling of mortarless interlocking cementitious blocks, with the assembly being easy to repair in the event of damage, will resist rust out, and will facilitate cleaning and other maintenance.

Another object of the present invention is to provide a new and improved combination die and pallet assembly for casting and subsequent handling of mortarless interlocking cementitous blocks, with the assembly forming sharp edged, frustro-conical projections on the blocks being cast thereon.

Another object of the present invention is to provide a new and improved combination die and pallet assembly for casting and subsequent handling of mortarless interlocking cementitious blocks, with the assembly including a solid heavy gage metal die and pallet plate having a predetermined array of frustro-conical apertures formed therethrough, and a solid heavy gage metal backing plate which is removably disposed in contiguous engagement with the bottom surface of the die and pallet plate.

Still another object of the present invention is to provide a new and improved combination die and pallet assembly of the above described character which improves the cast integrity of the blocks, and enhances the curing characteristics thereof.

The foregoing and other objects of the present invention, as well as the invention itself, may be more fully understood from the following description when read in conjunction with the accompanying drawings.

DESCRIPTION OF THE PREFERRED EMBODIMENT

Figure 1:
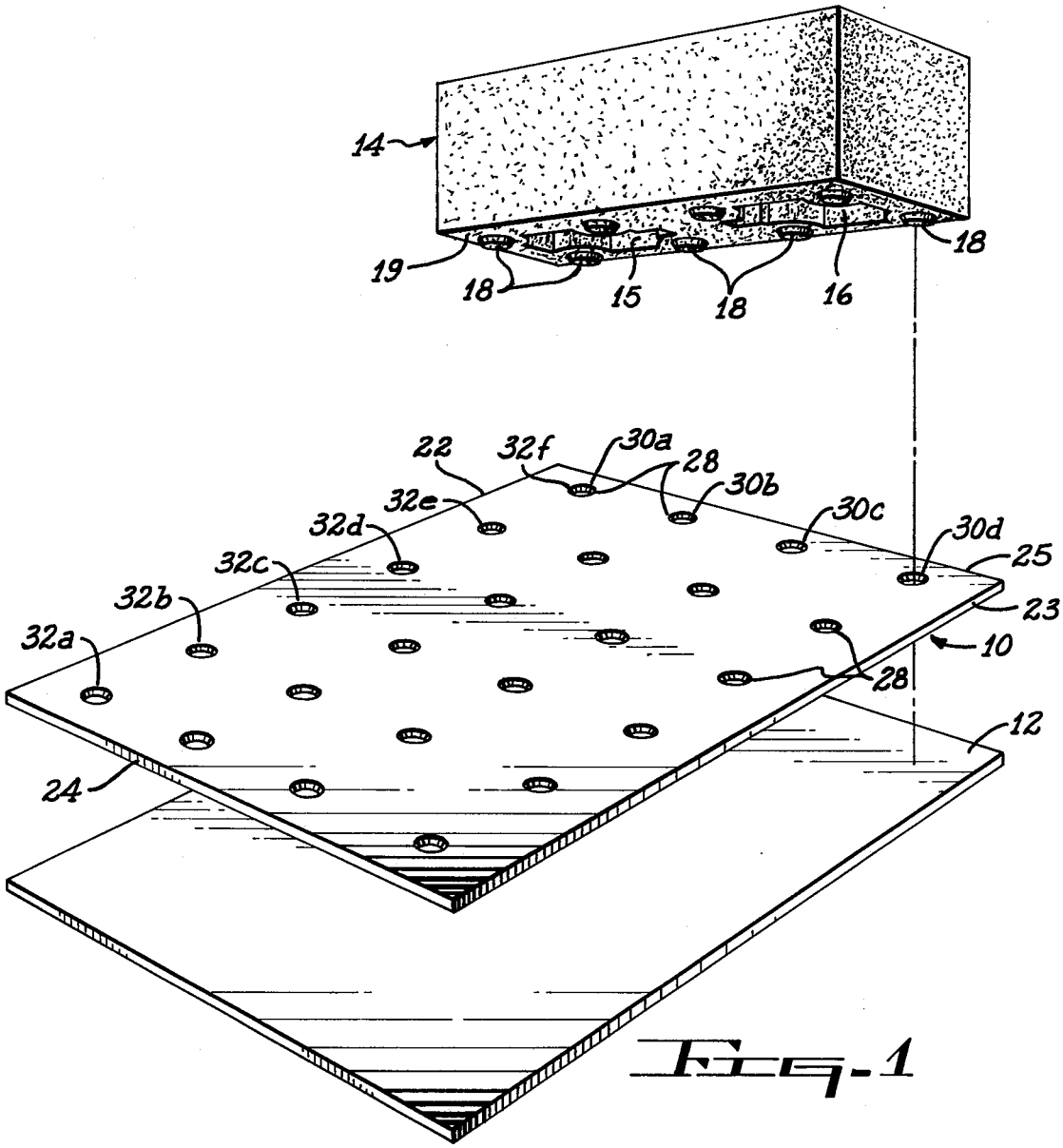
FIG. 1 is an exploded perspective view showing the combination die and pallet assembly of the present invention, and showing a mortarless interlocking cementitious blocks of the type cast thereon.

Referring more particularly to the drawings, FIG. 1 illustrates the combination die and pallet assembly of the present invention which is shown as including a die and pallet plate, that is indicated generally by the reference numeral 10, and a backing plate that is indicated generally by the reference numeral 12.

Before entering into a detailed description of the die and pallet plate 10, and the backing plate 12, a brief description of the type of mortarless interlocking cementitious blocks cast thereon is deemed advisable.

The block, which is indicated in its entirety by the reference numeral 14, is seen to be of conventional rectangular configuration with a spaced pair of vertically extending passages 15 and 16 formed therethrough. The blocks 14 are cast with eight male frustro-conical projections 18 which depend from a horizontal surface 19 which is the bottom surface during casting operations and becomes the top surface when a plurality of such blocks are employed in construction jobs.

The projections 18 are arranged in the horizontal surface 19 of the block 14 in two spaced longitudinally extending rows with four projections in each row. The four projections at one end of the block define a perfect square, the four projections at the other end of the block form an identical perfect square, and the four intermediate, or centrally located, projections also form a perfect square which is identical to the end surfaces. Although not shown, the upper horizontal surface of the block 14 is provided with a plurality of frustro-conical recesses, or the equivalent formed therein with those recesses arranged in an array which is identical to the above described array of the male projections 18. The male projections 18 and the female recesses (not shown), are complimental block interlocking elements, and due to the particular patterns of these projections and recesses, the blocks can be interlockingly assembled in the various dispositions commonly used in the construction industry.

It has long been the practice of the block industry to employ block making machines which are adapted to simultaneously cast three blocks in each cycle of the machine. Therefore, the combination die and pallet assembly of the present invention is preferably configured in conformity with this accepted practice. It will be understood however, that the combination die and pallet assembly of the present invention may be configured to accommodate more or less blocks if desired.

As shown, the die and pallet plate 10 is a rectangular planar structure defined by an opposed pair of spaced apart longitudinal side edges 22 and 23 and an opposed pair of spaced apart end edges 24 and 25. The die and pallet plate 10 is provided with a plurality of frustro-conical apertures 28 formed therethrough with the apertures arranged in four longitudinally extending rows 30*a*, 30*b*, 30*c* and 30*d*, and six transversely disposed rows 32*a*, 32*b*, 32*c*, 32*d*, 32*e* and 32*f*. As seen in FIG. 1, the cementitious blocks 14 (one shown) are disposed atop the plate 10 so that the longitudinal dimensions of the blocks are transverse with respect to the longitudinal dimensions of the plate. In this manner, two of the transverse rows 32*a*–32*f* are located below each of the blocks during the casting operations. For example, the transverse rows 32*e* and 32*f* are disposed below the block 14, and the spacing of the apertures 28 in their respective transverse and longitudinally rows is such that the male projections 18 of the block 14 will be cast in the precise array as hereinbefore described.

The die and pallet plate 10 is fabricated of solid heavy gage metal such as a suitable steel which has the properties necessary to resist denting, bending, or other damage which may and sometimes does occur as a result of usage.

With regard to the dimensions of the die and pallet plate 10 the length and width thereof are determined by the dimensions of the blocks and the number of blocks cast thereon. For example, the block 14 will typically be 16 inches in length, thus the width of the die and pallet plate 10 will be approximately 20 inches and the width of the block 14 is eight inches so that the length of the die and pallet plate 10 will be approximately 30 inches to accommodate three of the blocks 14 in side by side relationship. With regard to the thickness dimension, the die and pallet plate 10 is preferrably three-eights of an inch thick, but plates of one-quarter inch or of one-half inch can be used.

Figure 2:
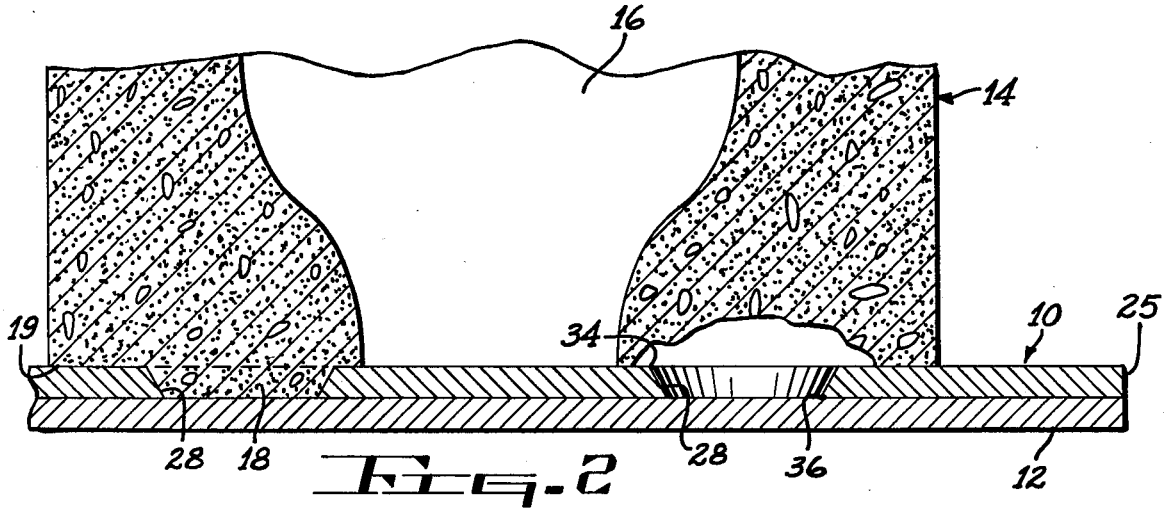
FIG. 2 is an enlarged fragmentary sectional view of the combination die and pallet assembly with a cast mortarless interlocking cementitious block supported thereon.

As seen best in FIG. 2, each of the frustro-conical apertures 28 are formed in the plate 10 so as to be inverted, i.e., the larger hole is in the upwardly facing surface. The apertures 28 which are formed such as by drilling, will be seen to have sharp edges 34 and 36 which results in the projections 18 being cast on the blocks without a radius at those locations. These sharp edges on the projections 18 result in improved interlocking fits between the plurality of blocks which are interlockingly assembled to form buildings, retaining walls, and the like.

The backing plate 12 is also of heavy gage metal, preferrably at least one-quarter of an inch thick and having length and width dimensions which substantially match that of the die and pallet plate 10.

In use, the die and pallet plate 10 is placed atop the backing plate 12, as seen best in FIG. 2, so that the backing plate is in contiguous engagement with the bottom surface of the die and pallet plate. In this manner, the apertures 28 formed through the die and pallet plate 10 are closed at their bottoms by the backing plate 12. When the blocks 14 (one shown) are cast in accordance with the well known and commonly employed techniques, the cement will flow into the apertures 28 and the blocks will be integrally cast with the male frustro-conical projections 18 thereon as hereinbefore described. When the casting operation is completed, the combination die and pallet plate assembly will support three of the blocks 14 thereon, with those blocks being in the uncured or green state. The die and pallet plate 10 is then moved off of the backing plate 12, and the die and pallet plate 10 having the blocks thereon is thereafter employed as a pallet which is transferred to the kiln (not shown). In actual practice, the separation of the die and pallet plate 10 from the backing plate 12 may be accomplished in any convenient manner with the preferred method being to fixedly attach, such as with bolts (not shown), the backing plate 12 to that portion of the block making machine (not shown) which raises and lowers the combination die and pallet assembly during each cycle of the machine. In this manner, a conventional conveyor system (not shown) can deliver and remove the die and pallet plates 10 in the usual manner.

Such removal of the die and pallet plate 10 from the backing plate 12 with the green blocks thereon will result in the male projections 18 of the blocks 14 having perfectly formed flat bottom surfaces due to the sliding movement of the die and pallet plate 10 off the backing plate 12. This removal also enhances curing of the green blocks in that the projections 18 of the blocks 14 will be directly exposed to the heat of the kiln (not shown) through the open bottoms of the apertures 28.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A combination die and pallet assembly upon which mortarless interlocking cementitious blocks are cast and subsequently transported, said combination die and pallet assembly comprising:

(a) a die and pallet plate having top and bottom planar surfaces, said die and pallet plate formed of solid heavy gage metal having a thickness dimension of at least one-quarter inch and having a plurality of apertures formed therethrough with those apertures arranged in a predetermined array; and (b) a backing plate of planar configuration in contiguous engagement with the bottom planar surface of said die and pallet plate during block casting operations and separable therefrom for subsequent block transport.

2. A combination die and pallet assembly as claimed in claim 1 wherein each of the apertures formed through said die and pallet plate are of inverted frustro-conical configuration.

3. A combination die and pallet assembly as claimed in claim 1 wherein the thickness dimension of said die and pallet plate is three-eights of an inch, at least.

4. A combination die and pallet assembly as claimed in claim 1 wherein said backing plate is of solid heavy gage metal having a thickness dimension of at least one-eight of an inch.

5. A combination die and pallet assembly as claimed in claim 1 wherein the apertures formed through said die and pallet plate are spacedly arranged in at least a pair of spaced apart rows with the spacing between each of the apertures being identical with the spacing between the rows.

6. A combination die and pallet assembly as claimed in claim 1 wherein said die and pallet plate is of rectangular configuration for supporting three of the mortarless interlocking cementitious blocks thereon during casting operations and subsequent transport thereof with each of those blocks disposed transverse to the longitudinal dimension of said die and pallet plate.

* * * * *